US010371346B2

(12) United States Patent
D'Ercole

(10) Patent No.: US 10,371,346 B2
(45) Date of Patent: Aug. 6, 2019

(54) DEVICE TO ILLUMINATE NOVELTY BUTTONS

(71) Applicant: Thomas D'Ercole, Cranston, RI (US)

(72) Inventor: Thomas D'Ercole, Cranston, RI (US)

( * ) Notice: Subject to any disclaimer, the term of this patent is extended or adjusted under 35 U.S.C. 154(b) by 176 days.

(21) Appl. No.: 15/206,217

(22) Filed: Jul. 8, 2016

(65) Prior Publication Data

US 2017/0006976 A1 Jan. 12, 2017

Related U.S. Application Data

(60) Provisional application No. 62/190,187, filed on Jul. 8, 2015.

(51) Int. Cl.
*F21K 2/06* (2006.01)
*F21V 3/06* (2018.01)
(Continued)

(52) U.S. Cl.
CPC ..... *F21V 3/0625* (2018.02); *A44B 1/04* (2013.01); *F21K 2/06* (2013.01); *G09F 3/12* (2013.01);
(Continued)

(58) Field of Classification Search
CPC ..... F21V 3/0625; G09F 3/12; G09F 13/18; A44B 1/04; F21K 2/16; G02F 2021/023
See application file for complete search history.

(56) References Cited

U.S. PATENT DOCUMENTS 5,143,439 A 9/1992 Lewis et al.
5,177,812 A * 1/1993 DeMars ..... A42B 1/004 2/209.13
5,239,450 A 8/1993 Wall
5,609,409 A 3/1997 Diehl
(Continued)

FOREIGN PATENT DOCUMENTS

WO WO 9635346 A1 * 11/1996 ..... A44C 3/00
WO WO-2002/07556 A2 1/2002
(Continued)

OTHER PUBLICATIONS

Anonymous, Disney Princess Glow Tiara, Available as early as Jul. 8, 2016, Unique Industries, Inc., Philadelphia, PA (Publ), (2 pages).
(Continued)

*Primary Examiner* — Sharon E Payne
(74) *Attorney, Agent, or Firm* — PCK IP Lawyers (USA) P.C.; Alan F. Feeney, Esq.

(57) ABSTRACT

A novelty button illumination device comprises a circular disk body having a circumferential rim. A recess is provided in the rim that holds in place one or more glow sticks. The illumination device engages a novelty button by either the novelty button's pre-existing pin-and-clutch fastening device or by a fastening device affixed to the illumination device. When engaged, the device together with the novelty pin may be worn on clothing and the like. The glow sticks are bent and snapped to activate a chemical light producing reaction and after such activation may be placed into the recess. Thereafter, during the time the glow sticks continue to glow, the novelty pin is illuminated by the glow sticks in the circumferential rim, enhancing the user's enjoyment in using the novelty pin illuminating device.

20 Claims, 6 Drawing Sheets

(51) Int. Cl.

| | |
|---|---|
| ***A44B 1/04*** | (2006.01) |
| ***G09F 13/18*** | (2006.01) |
| ***G09F 3/12*** | (2006.01) |
| *G09F 21/02* | (2006.01) |

(52) U.S. Cl.
CPC ..... *G09F 13/18* (2013.01); *G09F 2021/023* (2013.01)

(56) References Cited

U.S. PATENT DOCUMENTS

| | | | | |
|---|---|---|---|---|
| 6,908,206 | B1 | 6/2005 | Pinciaro | |
| D670,192 | S | 11/2012 | Fissell | |
| 2003/0115656 | A1 | 6/2003 | Leblang | |
| 2003/0162470 | A1 | 8/2003 | Peterson | |
| 2006/0185207 | A1 | 8/2006 | Mitcheltree | |
| 2007/0075080 | A1 | 4/2007 | Farnsworth et al. | |
| 2008/0313864 | A1* | 12/2008 | Suter ..... | A44B 1/14 24/113 R |
| 2009/0191990 | A1 | 7/2009 | Smith | |
| 2010/0236028 | A1* | 9/2010 | Clark ..... | A44B 1/04 24/113 R |
| 2011/0141735 | A1 | 6/2011 | Jablonski | |
| 2011/0226115 | A1* | 9/2011 | Dangerfield ..... | G09F 21/026 84/602 |
| 2013/0294057 | A1 | 11/2013 | Schwartz | |
| 2015/0109767 | A1 | 4/2015 | Fang | |

FOREIGN PATENT DOCUMENTS

| | | | |
|---|---|---|---|
| WO | WO-2003/007281 | A1 | 1/2003 |
| WO | WO-2007/045039 | A1 | 4/2007 |

OTHER PUBLICATIONS

Anonymous, Glow Badge "Class of 2015"Item # 70962F-A, Available as early as Jul. 8, 2016, Wal-Mart Stores, Bentonville, AR, (2 pages).

* cited by examiner

DEVICE TO ILLUMINATE NOVELTY BUTTONS

This application claims priority to and the benefit of U.S. Provisional Patent Application No. 62/190,187, which was filed on Jul. 8, 2015, the entire contents of which are incorporated by reference herein.

TECHNICAL FIELD

This invention related to novelty buttons, including chemiluminescent devices, and relates more particularly to a novelty button assembly wherein a novelty button is illuminated by a glow stick.

BACKGROUND OF THE INVENTION

Political buttons have been used in the United Slates since the first presidential inauguration in 1789, when George Washington's supporters wore buttons imprinted with a slogan. These early buttons were sewn to the lapel of a coat or worn as a pendant on a siring. The first campaign buttons with photographs were produced to promote the political platform of Abraham Lincoln in 1860. The first design for a pin-back button in the United States was patented in 1896, and contemporary buttons have many of the same design features.

Patents for various designs of ornamental badges and medallions were issued as early as 1802. (U.S. Pat. No. 476,939). U.S. Pat. No. 493,003 was directed to the first innovation to the design in 1893 by inserting a sheet of transparent film made of celluloid over a photograph mounted on a badge to protect the image from scratches and abrasion. U.S. Pat. No. 653,150 describes the use of a metal pin anchored to the back of the button to fasten the badge to the lapel of a coat so as to provide u means for connecting the ornamental shell or button to the bar or pin.

Early pin-back buttons from 1898 were printed with a popular cartoon character. The Yellow Kid, and offered as prizes with chewing gum or tobacco products to increase sales. These buttons were produced with a concave opening on the back side (which provided space to insert advertising), or with a closed back, filled with metal insert and fastener. These are called "open back" and "closed back" buttons. In 1945, the Kellogg Company, the pioneer in cereal box prizes, inserted prizes in the form of pin-back buttons into each box of Pep Cereal. Pep pins have included U.S. Army squadrons as well as characters from newspaper comics. There were 5 series of comic characters and 18 different buttons in each set, with a total of 90 in the collection.

Chemiluminescent devices are frequently used for entertainment at parties (in particular raves), concerts, dance clubs, sporting events and in festivals and celebrations around the world. "Glow sticks," as they are commonly referred to, is a self-contained, short-term light-source. It consists of a translucent plastic tube containing a tiny, brittle container within a flexible outside container. Each container holds a different solution. When the outer container is Hexed, the inner container breaks, allowing the solutions to combine, causing the necessary chemical reaction. After breaking, the tube is shaken to thoroughly mix the two components. A glow stick does not require an external energy source. The light cannot be turned off, and can be used only once.

Glow slicks were originally developed for the military. Several U.S. patents for glow-stick type devices were received by various inventors. Most of these are assigned to the U.S. Navy. U.S. Pat. No. 3,774,002 describes a packaged chemiluminescent material. U.S. Pat. No. 3,764,796 is directed to a chemical lighting device and U.S. Pat. No. 3,819,925 describes a chemiluminescent device. U.S. Pat. No. 3,933,118 claims a single glass ampoule that is suspended in a second substance that when broken and mixed together, provides the chemiluminescent light. This design, with its single glass ampoule inside a plastic tube filled with a second substance that when bent breaks the glass and then is shaken to mix the substances, most closely resembles the typical glow stick sold today.

The Inventor of the instant invention realized that the aesthetic appearance and entertainment value of traditional novelty button could be enhanced by illuminating the button, in particular by illuminating the outer edge. This has been done in the past, however, by using an electronic assembly comprising a printed circuit board with a light emitting diode requiring independent power sources such as batteries (U.S. Pat. No. 5,143,439). Other attempts back-lit the buttons using a transparent pocket in which the glow stick was placed with a translucent novelty button was affixed. (U.S. Pat. No. 6,908,206). Such attempts have been unsatisfactory as both are incapable of illuminating a pre-existing novelty button requiring the user to select a predetermined novelty button of the manufacturer's choice. In addition, the weight added by the batteries makes the button cumbersome and uncomfortable to wear and the need to replace the batteries increases the cost to the consumer.

It is desired herein to provide a novelty button whose image is lighted from the side and front. Such a button may be used over and over to celebrate or advertise different themes or occasions.

SUMMARY OF THE INVENTION

This invention provides a novelty button assembly that may be adapted to provide such buttons, with a variety of indicia on the lace of the button, with a chemiluminescent border that illuminates the button. One aspect of this invention relates to a device which comprises u circular disk body capable of supporting a novelty button wherein said circular disk body 10 having a circumferential rim. At least one light emitting element is carried on the circumferential rim of the disk body. The device does not prevent the wearing of the novelty button as it normally would be affixed to the wearer's apparel or other property.

Another aspect of this invention relates to a device to illuminate a novelty button of the wearer's choice comprising a circular disk body capable of encircling a novelty button with a flexible glow stick. At least one glow stick is provided comprising a flexible plastic tube which produces a light when the tube is bent and snapped to activate chemicals contained inside the tube which chemicals produce light when activated. A recess is provided on the disk body for releasably retaining the glow stick.

A third aspect of this invention relates to a means to illuminate a pre-existing, novelty button of the wearer's choice comprising the steps of providing a circular disk body having a circumferential rim wherein said rim contains a recess that encircles a novelty button in which a flexible glow stick maybe releasably contained, activating the chemicals contained inside the glow stick so as to produce light, and snapping the glow stick into the recess found on the rim of the disk body so that the glow stick retained.

BRIEF DESCRIPTION OF THE DRAWINGS

This invention will be described hereafter in the Detailed Description, taken in conjunction with the following drawings, in which like reference numerals refer to like elements or parts throughout.

FIG. 7 is the perspective view of the back of a novelty button FIG. 6 which utilizes a pin and hook-like means in which to secure said button to the wearer's clothing and the like.

FIG. 10 represents such a device after a novelty button has been snapped into the from of the device and a glow stick has been inserted into the interior recess.

DETAILED DESCRIPTION

A device to illuminate a novelty button illustrated generally as depicted in the Figures. The illuminating device FIG. 1 to which this invention relates can be worn using the fastening means already present on the novelty button FIG. 6. The user may use a novelty button in their possession or any other novelty button of their choosing that is compatible with the device. The user may also select a chemiluminescent device also of their choosing to illuminate their novelty button in the illumination color of their choice.

Figure 1:
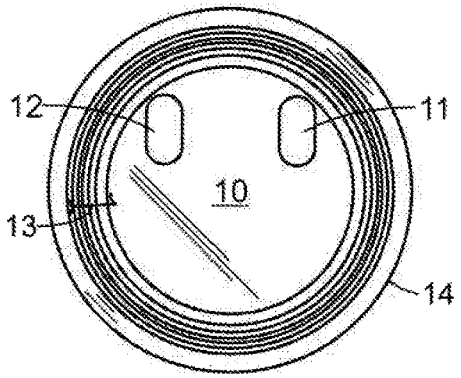
FIG. 1 is a perspective view of the illumination device looking from the top downward.
Figure 2:
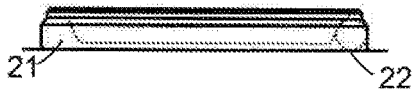
FIG. 2 is a side view of the illumination device shown in FIG. 1 in which a glow stick has been inserted into the recess of the device.
Figure 3:
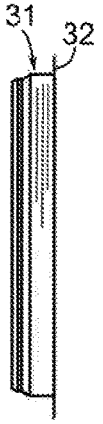
FIG. 3 is a side elevational view of the illumination device shown in FIG. 1.
Figure 4:
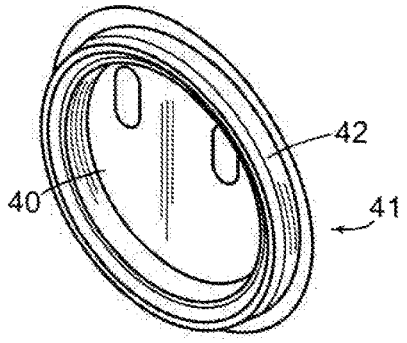
FIG. 4 is an elevational view of the illumination device shown in FIG. 1, particularly illustrating the illumination device with a 3-D perspective.

Novelty button illuminating device FIG. 1 comprises a circular disk body 10, 40 having a front and a hack and also having a circumferential rim 13 which extends 360° around disk body. The circular disk body 10 may be relatively flat or slightly domed. Circumferential rim 13 forms an interior cavity or recess 21 of FIG. 2 and 31 of FIG. 3. The interior recess 21 rises slightly above the circular disk body 10. The interior cavity 21 forms a 360° wall 42 extending perpendicularly downward from the circular disk body 10. A flange 14, 32, 41 perpendicular to the interior cavity wall 42, but below and parallel to the circular disk body 10, encircles the edge of the wall 42 created by the interior cavity 21.

The description of the novelty button illuminating device FIG. 1 given above is meant simply to set forth the general structure of the device. The exact size and shape of novelty button illuminating device FIG. 1 and how flat or domed the circular disk body 10 might be are not important to this invention. All that is required is that novelty button illuminating device FIG. 1 have a size and shape which allows a person to wear a novelty button FIG. 6 of their choice that is illuminated by a chemiluminescent device.

The novelty button illuminating device FIG. 1 of this invention has a radially outwardly facing recess 21 provided in circumferential rim 13 of the illuminating device FIG. 1. The recess 21 carries a glow stick 22 which is also sometimes referred to as a light stick. Glow sticks are themselves well known and comprise flexible plastic tubes which enclose a chemical carrying capsule. When glow slicks are bent and snapped, the capsule is broken to allow the chemicals 10 be mixed by shaking glow sticks. The chemicals then react to produce a vibrant light. When engaged, the glow stick illuminates the novelty button FIG. 6 from the side and top and elicits attention from observers.

Figure 5:
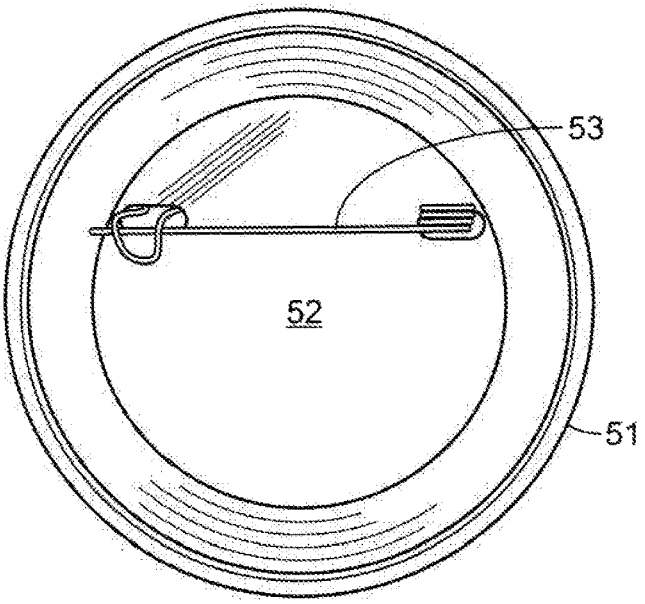
FIG. 5 is the perspective view of the back of a novelty button which utilizes a safety pin-like fastening device.
Figure 9:
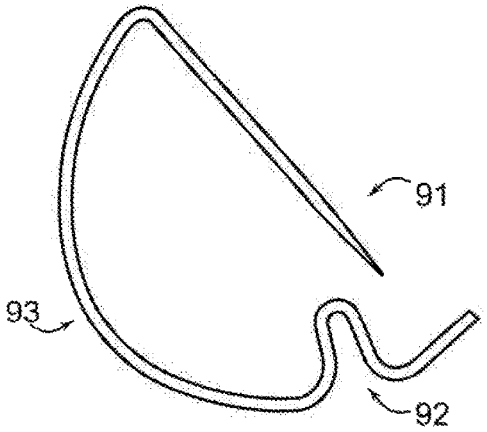
FIG. 9 is the pin and hook fastening device depicted in FIG. 7 after it has been removed from the button. When the fastening device is compressed, i.e. pressure applied to both the pin portion and the hook portion causes both to move closer to each other which in turn decreases the angle of the portion in between the pin and hook, it can be inverted into the groove of the button. Once the pressure is release from the fastening means, the fastening device reverts back to its relaxed state which in turn causes the fastening device to exert pressure against the wall of the groove which keeps the fastening assembly in place on the button.

The illuminating device FIG. 1 of this invention contains means in which to engage a pin-back button or pinback button, pin button, button badge or simply pin-back or badge (hereinafter referred to as "novelty button"). The term "novelty button" as used herein is not limited to articles having fastening means. Any article displaying a word, slogan, symbol, picture, photograph or the like on any medium such as cardboard, plastic metal and the like may be used. A novelty button FIG. 6, as used herein, is a button or badge that can be temporarily fastened to the surface of a garment using a safety pin 53, or a pin formed from wire FIG. 9, a clutch or other mechanism which is affixed to the rear baseplate 52 of the button FIG. 5. This fastening mechanism 53 is anchored to the hack side of a button-shaped metal disk 52, either flat or concave, which leaves an area on the front of the button 51 to carry an image or primed message. To accommodate traditional novelty button, the illuminating device FIG. 1 of the instant application has two, evenly-situated apertures 11, 12 in the circular disk body 10 situated in such a way so as to naturally accommodate the fastening means 53 of a traditional novelty button FIG. 6. The apertures 11, 12 may be formed during the initial molding, thermal forming or vacuum forming process used to create the circular disk body 10 or the apertures 11, 12 may be bored into the circular disk body 10 after its been made. The apertures 11, 12 are situated on the circular disk body 10 at the same positions that the pin and clasp FIG. 9 are located on a traditional novelty button FIG. 6 so that when the user inserts the pin portion 91 of the fastening mechanism FIG. 9 of the traditional button through the first aperture 11, the clasp member 92 of the pin protrudes through the opposite aperture 12 or vice versa. When the user desires to wear the device FIG. 1, the pin portion 91 is pushed into and out of the wearer's clothing and then engages the clutch mechanism 92 to secure the illuminating device FIG. 1 with the selected novelty button FIG. 6 to the users clothing. This fastening means is constructed of a single wire wherein a circular section 93 connects the pin 91 portion to the clasp member 92 so that when pressure is applied to insert the fastening means into the back of the novelty button FIG. 6 it contracts. When the pressure is slopped, the natural tendency of the fastening means is to flex outward which exerts pressure on the sides of the novelty button thus securing the fastening means. When the user wishes to remove the illuminating device FIG. 1 with attached button FIG. 6, the user disengages the pin 91 from the clutch 92, pulls the pin 91 through the user's clothing, separates the novelty button FIG. 6 from the illuminating device FIG. 1 by withdrawing the pin 91 and clutch 92 through the apertures 11, 12 of the circular disk body 10, and engages the pin 91 and clutch 92 of the fastening means FIG. 9 of the novelty button which has been separated from the illumination device FIG. 1.

Figure 7:
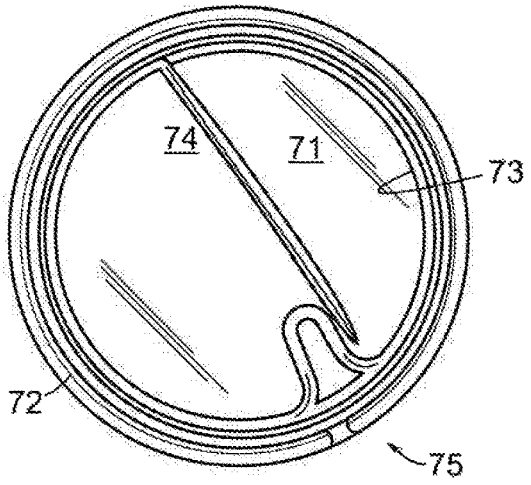

FIG. 7 depicts the back of the device after both the novelty button 71 and glow stick 75 have been installed. The pin 91 and clutch 92 have been inserted through the aforementioned apertures (not shown) of the circular disc body 74. The back of the novelty button 71 is flush with the front of the device. The interior recess 72 extends downward past the front of the novelty button creating a translucent wall 73 surrounding the outer edge of the novelty button which rises above the front of the novelty button. The glow stick 75 which is inserted into the interior recess 72 completely surrounds the novelty button illuminating the novelty button from above.

Figure 8:
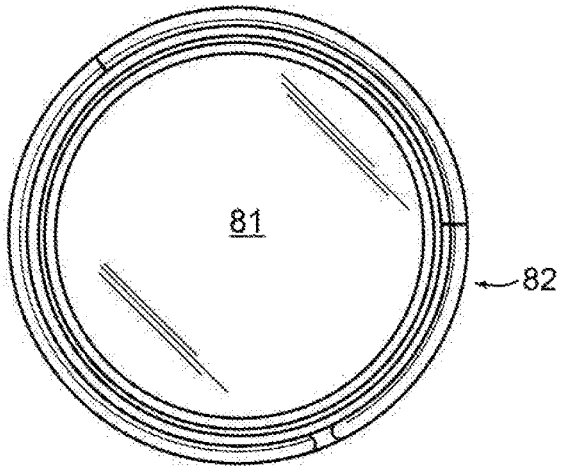
FIG. 8 is the button of FIG. 7 wherein the fastening device has been removed. The face of the pin is surrounded by circumferential groove made to accommodate the pin and hook fastening device.

FIG. 8 depicts the from of the device (which faces the observer when the user affixes the device to one's clothing) when both the button and glow stick have been inserted into the device. The front of the novelty button 81 when the fastening device is inserted through the apertures of the circular disc body is situated below the glow stick 82 when the glow stick 82 is inserted into the interior recess of the device. When the glow stick is activated, it shines light downward upon the face of the novelty button 81 thus illuminating the message displayed on the button.

Figure 6:
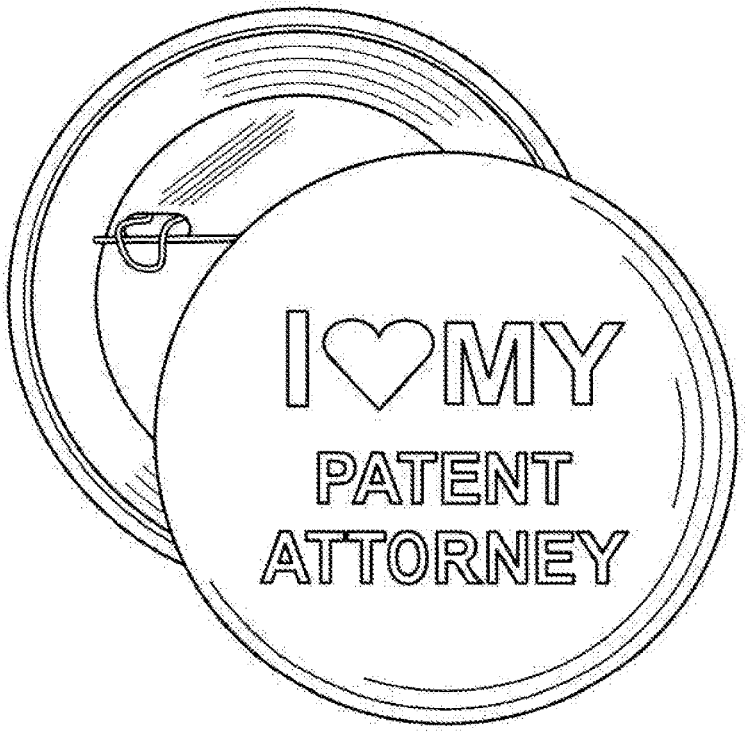
FIG. 6 is the enlarged view of the front of a representative novelty button upon which a slogan, drawing, picture and the like, for example "I♥My Patent Lawyer" is displayed thereon and an enlarged part view of the rear of FIG. 5 showing a fastening pin engaged with a fastening hook.

The illumination device FIG. 1, after securing the novelty button FIG. 6 through the two apertures 11, 12 and securing the glow stick in the recess 21, is preferably worn so that the exposed glow stick is between the device FIG. 1 and the wearer. The recess 21 extends beyond the circular disk body 10 so that when the glow stick is secured in the recess 21, it is either flush with or slightly extends beyond the face of the attached novelty button FIG. 6. The entire illumination device FIG. 1 is made of a translucent material allowing for the light produced by the glow stick when it is activated to be seen by observers. Although not preferred, the illumination device FIG. 1 with the attached novelty button FIG. 6 and secured glow stick, maybe worn so that the exposed glow stick faces away from the wearer. If the wearer desires to wear the illumination device FIG. 1 in this manner, the novelty button FIG. 6 would need to engage the illumination device from the underside of the circular disk body 10. The apertures 11, 12 would still provide a means in which to secure the novelty button FIG. 6 to the illumination device FIG. 1.

Figure 10:
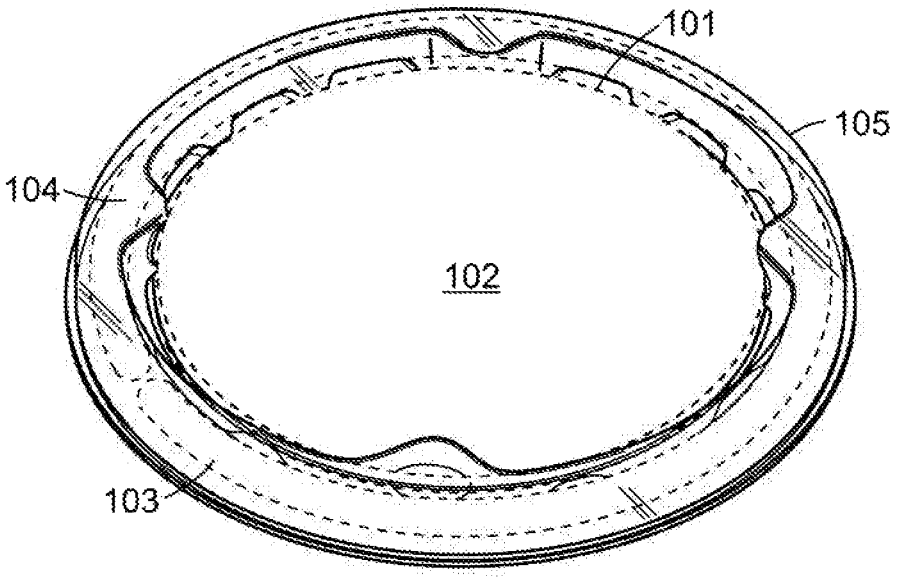
FIG. 10 is the depiction of a second embodiment of the invention wherein a portion of the circular disc body has been removed creating a large aperture in which the entire fastening means of a novelty button may be inserted and indentations or undercuts extend from the wall of the interior recess towards the center of the device so as to engage a novelty button and keep it securely affixed to the device when used.

In a second preferred embodiment of the claimed invention as depicted in FIG. 10, a large aperture 102 in the circular disc body 101 has been added. This aperture allows for the entire fastening device, such as a safely pin or clasp, to be free and capable of being used once the novelty button is inserted into the top of the claimed device. This embodiment includes undercuts 101 molded into the walls of the interior recess 105. These undercuts create indentation or protrusions. The undercuts that extend outward from the walls of the interior recess 105, towards the center of the device. When pressure is applied to these undercuts 101, such as the pressure created when a user snaps a novelty button into the front of the device, the indentations, become deformed to allow the novelty button to be pushed flush to the circular disc body 101. Once the force used to insert the novelty button into the device ceases, the indentations revert back to the original shape. This, in turn, causes the indentations to exert pressure on the novelty button keeping it affixed to the device until such time as the user exerts an outward force on the button causes the indentations to once again deform removing the retention force upon the novelty button. Similar "inward" undercuts were formed in the walls of the interior recess 105. These indentations, which extend into the interior recess 105, deform when pressure is applied by the user to insert a glow stick 103 and 104 into the interior recess 105. When the user applies pressure to a glow stick so as to insert said glow stick into the recess 105 so that the glow stick is flush with the interior recess 105, that pressure causes the inward indentations to deform outward. Once the glow stick is inserted and the user ceases applying pressure to the inward indentations, the inward indentations attempt to return to the original shape thus applying pressure to the glow stick, which in turn, secures the glow stick to the device.

Figure 11:
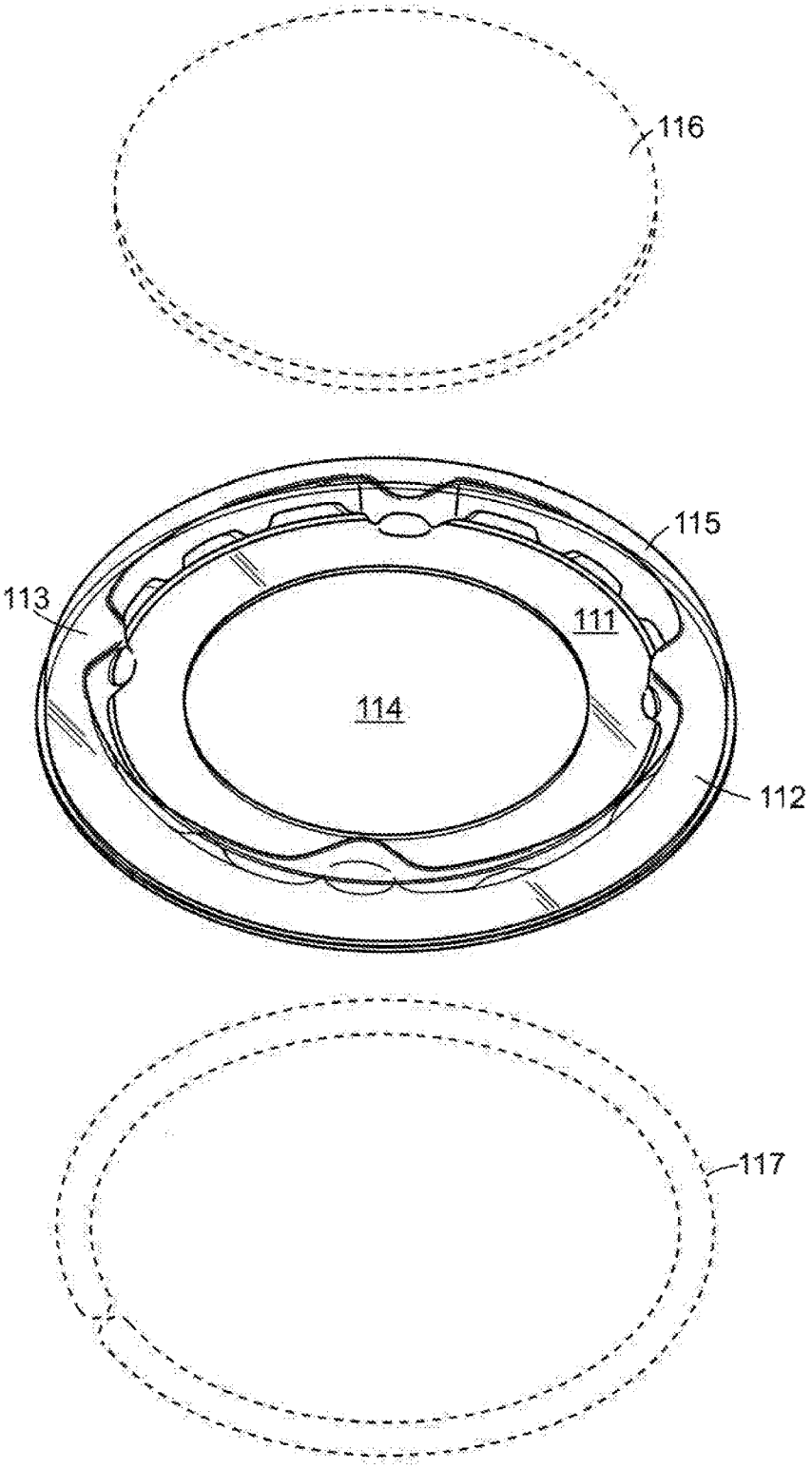
FIG. 11 is a "blown up" view of FIG. 10. The novelty button and glow stick are represented in dotted line figures. From this perspective, it is shown that the top portion of the device accepts the novelty button with the button's fastening device pushed through the aperture whereas the circular glow stick is inserted into the recess found on the opposite side of the device.

FIG. 11 illustrates how the device is used. A novelty button 116 is inserted into the front of the device wherein the fastening means (not shown) of the button 116 is inserted through the aperture 114 of the circular disc body 111 to the opposite side of the device (not shown). The inward undercuts 113 of the interior recess 112 become deformed when pressure is applied by the user when inserting the novelty button 116 into the front of the device. Once pressure is no longer applied by the user on the novelty button 116, the inward undercuts 113 revert back to their natural formation. This, in turn, causes the inferior undercuts 113 to apply pressure to the novelty button securing the button to the device. When the user attempts to insert a glow stick 117 into the interior recess 112 located on the opposite side of the device, the pressure exerted by the user to insert the glow stick 117 causes the outward undercuts 115 to become deformed allowing for positioning of the glow stick 117 into the interior recess 112. Once the glow stick 117 is positioned within the interior recess 112 and the user stops applying pressure to the glow stick 117, the outward undercuts 115 attempts to revert back to their relaxed slate which in turn applies pressure to the inserted glow stick 117, securing the glow stick 117 in the interior recess 112 of the device.

Figure 14:
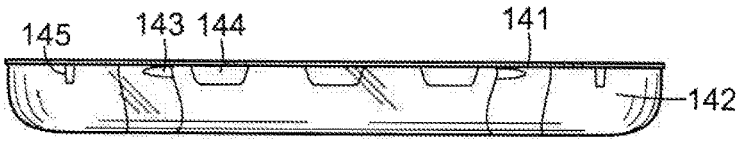
FIG. 14 is a view of the second embodiment from its side. The device is made from a translucent material so interior undercuts and indentions are visible.
Figure 13:
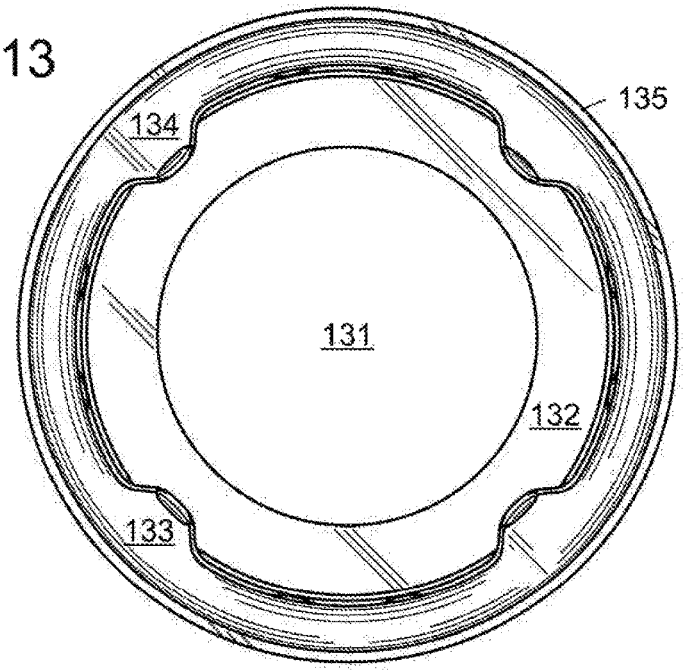
FIG. 13 is a view of the second embodiment of the claimed device from the perspective of the back of the device. From this perspective, the internal recess extends downward from the circular disc body. The recess gets narrower as it gels deeper creating a tight fit once a glow stick is inserted into the recess. Small undercuts extending from the walls of the recess into the recess further exert pressure on the installed glow stick securing the glow stick in the device when in use.
Figure 12:
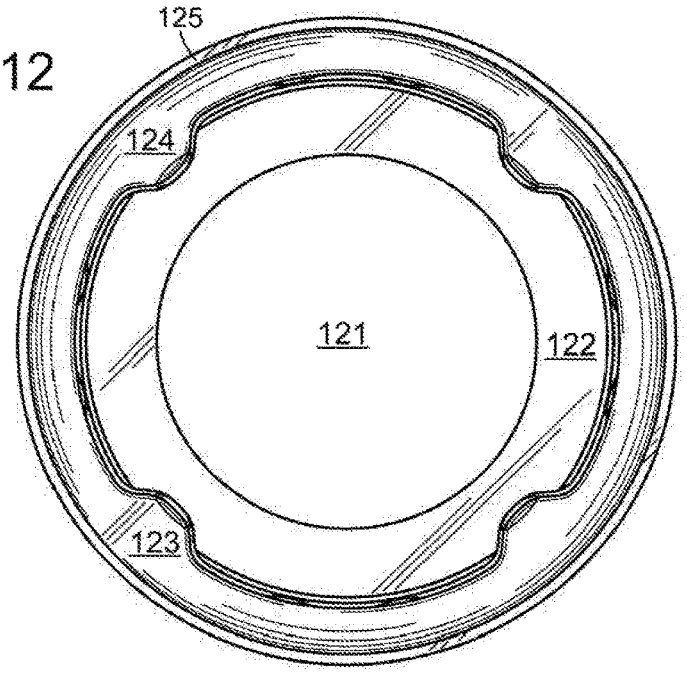
FIG. 12 is a view of the second embodiment of the claimed device from the front of device illustrating how the interior rises above the circular disc body with the undercut indentations coming out from the wall of the recess towards the center of the device.

FIG. 12 is a view of the second embodiment of the claimed device from the from of device illustrating how the interior recess 124 rises above the circular disc body 122 with the inward interior undercuts 123, 124 coming out from the wall of the recess 125 towards the removed center 121 of the device. FIG. 13 is a view of the second embodiment of the claimed device from the perspective of the back of the device. From this perspective, the internal recess 135 extends downward from the circular disc body 132. The recess 135 gets narrower as it gets deeper creating a tight fit once a glow stick is inserted into the recess. Small undercuts 133, 134 extending from the walls of the recess 135 into the interior of the recess 135 further exert pressure on the installed glow stick securing the glow stick in the device when in use. The fastening means of the novelty button is inserted through the aperture 131. FIG. 14 is a view of the second embodiment from its side. The device is made from a translucent material so interior undercuts and indentions are visible. Undercuts 141, 143, 145 jutting into the internal recess 142 that secure the glow stick in place and undercuts 144 which extend beyond the walls of the interior recess 142 secure the novelty device in place.

The illumination device FIG. 1 of the instant application is formed of transparent or translucent plastic, such as polystyrene, polyethylene, polypropylene or polyvinyl chloride, preferably polyethylene terephthalate, otherwise known as PET and sold as DACRON® (Invista, Washington, D.C., USA), and more particularly 0.015 utility PET, so as to diffuse transmitted light, however, other transparent or translucent plastics may be used. In preference the light guide is to be constructed using a molding, vacuum forming or thermal forming process, or any other known or yet to be discovered, that creates the illumination device using a flexible transparent polymer wherein said device comprises a snap fitting recess 21 along the outer circumference of the circular disk body 10 configured to receive a glow stick therein.

In certain embodiments of the claimed invention, the material used to form the device has great elasticity properties and is able to resume its normal shape spontaneously after contraction, dilatation, or distortion.

Glow sticks come in different lengths and can produce light of different colors. A glow stick consists of a tube having a flexible outer tube and a brittle inner tube. A first liquid (a hydrogen peroxide solution) is stored within the inner tube (a glass vial) and a second liquid (phenyl oxalate ester and a dye) between the inner and outer tubes. When the plastic outer tube is bent the inner lube breaks, thereby allowing the two liquids to mix and causing a chemical reaction that makes the stick produce a bright fluorescent glow. The particular dye used in the chemical solution gives the light a distinctive color. Once activated, the stick will remain illuminated for a period of time (usually less than ten hours) until it ceases to glow and is then disposed of. Glow sticks do not glow or give off light prior to the time they are activated or alter the chemical light producing reaction ends.

The recess 21 has a length which is chosen to approximately match the length of glow sticks and to, in the preferred embodiment, encircle the novelty button FIG. 6 secured on the top portion of the circular disk body 10 by either the fastening means 52 of the novelty button FIG. 6 through apertures 11, 12 in the circular disk body 10 or by another fastening means. Preferably, one glow stick is inserted into a recess 21 and when so inserted, will extend over most or all or the length of recess 21. In addition, the cross-sectional shape of the recess 21 is chosen so as to slightly pinch or grip the outer diameter of glow stick with a frictional fit. Thus, when a glow stick is inserted into the recess 21, it is simply held therein with a press fit and/or friction fit. The resistance created when a commercially-available linear glow stick is bent, causes the ends of the glow sticks to want to snap outward back into its original linear form. The ends of the glow stick exert forces on the walls 31 of the recess 21 and these forces, generally, hold the glow stick in place. This press fit must, however, be tight enough so that the glow stick will not become dislodged from novelty button illumination device FIG. 1 even when the wearer of the device engages in strenuous physical activity such as dancing.

In another embodiment of the instance invention, the illumination device FIG. 1, does not have a flange encircling the device that is parallel to the plane of the circular disk body 10. In this embodiment, the outer walls 31 of the recess 21 curve inwards towards the circular disk body 10. The curvature of the walls 31 of the recess 21 keep the glow stick in place during use of the illumination device FIG. 1.

In yet another embodiment, the illumination device FIG. 1 may be configured so as to be able to secure a novelty button in place by a press fit and/or friction fit. In particular, the recess 21 that extends outward from the circular disk body 10 would haw an outward, flexible flange or rim smaller in diameter than the novelty button. When the user places the novelty button on top of the flexible flange or rim and applies downward pressure, the flange or rim temporarily deforms downward allowing for the novelty button to pass the rim. Once the button has passed the flange or rim, the natural elasticity of the flange/rim causes the rim to return to its original state. The flange or rim now acts as means in which to secure the novelty button in place.

The invention may optionally utilize commercially available connectors. The connectors shape the glow sticks into the desired circular shape. The connector holds the opposing ends of a glow stick in close proximity, and thereby maintains the glow stick in a ring shape. Connectors known in the art are sized to closely match the diameter and shape of the tubular glow stick, i.e. 4.9 mm, 5 mm and/or 6 mm. When the ends of the glow stick are forcefully inserted into the opposing openings of the connector, the ends of the glow stick are held in place by a tension 111 that is tight enough to hold the ends of the glow stick in place while maintaining the circular shape. Tension is created when the connector is bent slightly to receive the ends of the glow stick. The tension in the connector must be sufficient enough so that the ends of the glow stick do not become disengaged from the connector at any time and are only removed from the connector upon the user forcefully pulling the ends out of the glow stick. The connector is preferably made of flexible, low cost, low density, polyethylene.

A glow stick can be pushed into the recess 21 until it is gripped and held in the recess 21. The user would, of course, first bend and snap the glow stick immediately prior to insertion in order to initiate the chemical reaction that produces the light. After the glow stick begins glowing, it can be inserted into the recess 21. The light provided by the glow stick will then last for a number of hours.

The novelty button illumination device FIG. 1 of this invention will enhance the entertainment value of an ordinary, pre-existing novelty button FIG. 6. The colored light given off from circumferential rim 13 of the device FIG. 1 will be quite pretty and will enhance the visual appearance of a novelty button FIG. 6 as it is worn, particularly when the novelty button is worn at dusk or night or in other low light conditions. In fact, illumination device FIG. 1 of this invention lends itself to being used at times when illumination novelty buttons could not even be seen. This should encourage and increase use of the illumination device of the instant application.

Because the light provided by the chemical reactions inside glow stick lasts only for a number of hours, glow sticks will eventually stop glowing. These depleted glow sticks must be replaced if one wishes to continue to illuminate a novelty button with the light emitting properties provided by glow sticks. The user can easily remove or dislodge depleted glow stick from the recess 21. The user simply twists the flexible device which easily releases the glow stick from the recess 21.

A number of original and replacement glow sticks will desirably be packaged and sold with the novelty button illuminating device FIG. 1 when the device is sold. Even the original glow stick will probably not be pre-installed in the recess 21 since such a pre-installed glow stick might accidentally be activated during shipment or sale. Instead, upon purchasing a novelty button illuminating device FIG. 1 of this invention, the user would, upon initial use, take one of the packaged glow sticks, bend and snap them to initiate the chemical reactions that produce the light, and then insert the glow stick into the recess 21. At some time after the original glow stick is depicted, and immediately prior to the next use of the novelty button illumination device, the user would remove the depleted glow stick from the recess 21 and insert a replacement glow stick, after first bending and snapping the replacement glow stick to initiate the chemical light producing reaction.

As glow sticks can produce light in different colors, a number of glow sticks capable of producing different colors will desirably be packaged with the novelty button illumination device. The user can then select what colors are to be used in combination with one another according to the user's individual taste.

Various additional modifications of this invention are apparent to those skilled in the art. For example, recess 21 that holds the glow stick is desirably placed on circumferential rim 13 of the illumination device so that it extends outward from the circular disk body 10 and the novelty button affixed thereto so as to illuminate the novelty button from in front of said button. Other recesses, however, may be incorporated into the circular disk body 10 so as to illuminate the novelty button from behind, if desired, either in addition to recess 21 in circumferential rim 13 or in place of such recess. Moreover, the recess 21 used in circumferential rim 13 could obviously be varied. While it is preferred that recess 21 extend around the entire circumferential rim 13 of the illuminating device FIG. 1 so as to encircle the novelty button in a substantially continuous manner so that the entire rim looks to be lighted when a glow stick is activated, the recess 21 in the circumferential rim 13 could be non-continuous and could be separated by solid sections. In this case, the light glowing from circumferential rim 13 would be a series of spaced sections of light and not a more or less continuous band of light.

The device may also include a movable lab made of a flexible material that lies underneath the glow stick when it is engaged with the recess 21 of the circular disk body 10. When the glow stick becomes depleted, the user would merely pull lightly on the tab which in turn should cause the glow stick to disengage with the recess 21 thus facilitating the removal of the depleted glow stick from the recess 21.

Glow slicks could be laid in an abutting end-to-end relationship around such a continuous recess 21. In the event that a long enough and flexible enough glow stick is available, the entire recess 21 could be filled with a single glow stick.

Suitable glow slicks (chemiluminescent glow products) can be obtained, for example, from OmniGlow, Inc. (Springfield, Mass. USA).

The illuminating device FIG. 1 may be modified for use as a pendant, charm, earring or keychain. The illuminating device FIG. 1 may be made of molded glass, paper or plastic. The embodiments of the present invention can be manufactured in different sizes, shapes and thicknesses. The chemiluminescent articles may be small or large glow sticks, disks or other shapes. Multicolored fiber optics powered by glow slicks may also be utilized.

In other embodiments, the glow stick may be removably adhered 10 the illumination device. The glow stick may be in form of a button or wafer which are commercially available from different suppliers including OmniGlow, Inc. (Springfield, Mass. USA). The glow stick can have indicia thereon. When lit, the chemiluminescent material with the glow stick will cause the indicia to be visible in a light deprived environment, such as in a concert hall after the lights are turned off. The chemiluminescent material will all for the indicia to be visible for at least a period of time during which the chemicals cause the stick to be lit. The indicia can be a source identifier, such as a trademark or service mark (name of a product, company, etc.) for advertising and or marketing a product and/or a service connected to such source identifier.

Novelty buttons come in varying sizes, such as 1 inch, 1¼ inch, 1½ inch, 1¾ inch, 2 inches, 2½ inches, 3 inches, 3½ inches, 4 inches and 6 inches. To accommodate different sized novelty button, the circular disk body 10 has a diameter of 1 inch, 1¼ inch, 1½ inch, 1¾ inch, 2 inches, 2½ inches, 3 inches, 3½ inches, 4 inches and 6 inches, respectively. In the preferred embodiment, the circular disk body 10 is 2¼ inches in diameter and the diameters of the recess 21 and outer flange 14 together measure ½ an inch. A novelty button FIG. 6 that is 2% inches in diameter just covers the circular disc body 10. The illuminating device depicted in FIG. 1 is dimensioned for receiving a flexible glow stick approximately 8 inches in length with a width and height of inches. Such dimensions are merely illustrative, and are not intended to be limiting of the invention.

In the preferred embodiment, when the illuminating device FIG. 1 is attached to the novelty button FIG. 6, the pin-back 52 of the novelty button not only engages the novelty button with the illuminating device FIG. 1, but also is used to affix the novelty button-illumination device to the wearers clothing. In other embodiments, the novelty button, or equivalent labels, stickers or cards, may be permanently affixed to the front of the illuminating device FIG. 1 using an adhesive such as but not limited to, acrylics, bio-adhesives, contact adhesive, cyanoacrylics, epoxy, glue, hot melt adhesive, paste, polyester resins, polyols, polyurethane, pressure sensitive adhesive, rubber cement and stitching. When the pin-back of a novelty button is not used to secure the novelty button-illumination device to the wearers clothing, the back of the illumination device has affixed to it a fastening device capable of releasably attaching the button-illumination device to the wearer's clothing using a fastening device, including but not limited to, butterfly clutches, buttons, buckles, circle cotters, eyelets, grommets, hook-and-eye fasteners, hook-and-loop fasteners, lobster clasps, magnets, pins, rubber bands, snap fasteners, straps, twist ties. VELCRO® brand filamentary hook and loop material, and zippers. Any other suitable means for attachment may also be employed without departure from the invention.

The term "novelty button" as used herein includes not only includes traditional buttons comprising a metal or plastic circular back plate configured so as to have a fastening device such as a safely pin attached to the back or secured between two plates or a fastening device that is retained in the circular, curved-in edge of the button and further having a from upon which a slogan, saying, drawing, picture and the like is displayed thereon, but also cut outs, made of any material upon which a slogan, saying, drawing, picture or the like may be displayed thereon, like cardboard, plastic, metal or the like, capable of being affixed to an object by an adhesive or fastening device.

In an alternative embodiment, the illumination device is configured so as to form a hollow cavity surrounding the circular disk. Illumination is not provided by a pre-formed glow stick, but by a chemiluminescent fluid which is directly deposited inside the hollow cavity 21 or a circular, fragile glass vial. An O-ring seal prevents leakage. The recess 21 is then closed or sealed. When the flexible device is slightly bent, the chemiluminescent materials inside the hollow cavity 21 are allowed to mix, i.e. the glass vial breaks thus releasing its contents into the space between the glass vial and the hollow cavity which contains a second chemical, causing the hollow cavity to emit light that illuminates the novelty button FIG. 6 attached to the device.

In another form, the invention may be adapted to illuminate a non-circular badge or label, particularly suited for use in darkness. Possible shapes include, but are not limited to, triangles, rectangles, squares, quadrilaterals, parallelograms, hexagons, heptagons, octagons, semicircles, crescents and the like. If the shape of the object to be illuminated is not circular, for instance, a rectangle, more than one flexible glow stick may be used. The female-to-female connecting devices are reconfigured accordingly. If for instance a rectangular badge was to be illuminated, the traditional female-to-female connecting devices would not be linear, but in the form of a right angle. In this example, four glow slicks would be required to completely surround the badge for optimal lighting.

The above description will enable any person skilled in the art to make and use this invention. It also sets forth the best modes for currying out this invention. There are numerous variations and modifications thereof that will also remain readily apparent to others skilled in the art, now that the general principles of the present invention have been disclosed.

As such, those skilled in the ad will appreciate that the conception, upon which this disclosure is based, may readily be utilized as a basis for the designing of other structures, methods and systems for carrying out the several purposes of the present invention. For example other sports throwing projectiles may be similarly configured such as softballs, baseballs etc. It is important, therefore, that the claims be regarded as including such equivalent constructions insofar as they do not depart from the spirit and scope of the present invention.

I claim:

1. A device comprising a circular disk body having means in which to engage a novelty button and a circumferential rim wherein said rim has a recess that engages a chemiluminescent material, wherein said device is capable of illuminating a novelty button installed therein;

wherein when said novelty button is installed in said device, the chemiluminescent material encircles the installed novelty button;

wherein when the user of said device desires to exchange a novelty button that has been installed in said device, said device allows the user to disengage said novelty button from the device by pushing the installed novelty button outward from the body of said device thereby disengaging said installed novelty button and thereafter swapping out the installed novelty for a different novelty button that is installed into said device by pushing said different novelty button the body of said device until said different novelty button is secured thereto; and further wherein said exchange does not require the use of a tool.

2. The device according to claim 1, wherein said means in which to engage a novelty button one or more apertures in which a pin and hook fastener on a novelty button are inserted through said apertures and are able to be engaged.

3. The device according to claim 2, comprising two apertures spaces so that the pin portion of the fastener on a novelty button is inserted through one aperture and the hook portion of the same fastener in inserted through the second aperture wherein when both the pin and hook of the novelty pin are inserted through the apertures of the device, the pin in still capable of being inserted into a material and then out of the same material and still be capable of engaging the hook of the novelty pin.

4. The device according to claim 1 further comprising a flange that encircles the outer edge of the rim wherein said flange is parallel to said circular disk body.

5. The device of claim 1, wherein said recess extends beyond the plane of the circular disk body.

6. The device of claim 5, wherein said recess has an external wall that extends perpendicularly above the plane of the circular disk body.

7. The device of claim 6, further comprising a flange extending outward from the top of said wall of said recess wherein said flange extends outward and is parallel to the plane of the circular disk body.

8. The device according to claim 1, wherein said chemiluminescent material is a glow stick.

9. The device according to claim 1, wherein said recess creates a tension fit with the glow stick wherein said tension fit retains said glow stick in said recess.

10. The device according to claim 1, wherein said device is comprised of a transparent or translucent material.

11. The device according to claim 10, wherein said transparent material is a flexible plastic.

12. The device according to claim 1, wherein said recess is configured so as to retain a commercially-available glow stick wherein when said glow stick is inserted into the recess the ends of said glow stick meet and the glow stick completely surrounds the edge of the circular body disk.

13. The device according to claim 1, wherein said an inner circular portion has been removed from the circular disk body.

14. The device according to claim 13, wherein the inner edge of the circular disk body created by the removal of said inner circular portion is curved inward so as to engage the edge of a commercially-available novelty button securing said button to said device.

15. The device according to claim 1, wherein said rim is designed so as to have an outwardly extending flange made of a flexible material that extends partially over the circular disk body.

16. The device of claim 15, wherein said flange is capable of securing a novelty button in place with said device.

17. The device according to claim 1, further comprising elastic indentations formed into the recess.

18. The device according to claim 17, wherein said indentations extend outward from the recess towards the center of the device wherein when a novelty button is inserted into the device said indentations become deformed so as to allow said novelty button to be flush with device and then said indentations revert back to the original shape causing the device to apply pressure to said novelty button which secures said novelty button to the device.

19. The device according to claim 17, wherein said indentations extend into the recess of the device wherein when a chemiluminescent object is inserted into the recess of said device said indentations become deformed so as to allow said chemiluminescent object to be flush with said device and then said indentations revert back to the original shape causing the device to apply pressure to said chemiluminescent object which secures said chemiluminescent object to the device.

20. The device according to claim 2, comprising a singular aperture of sufficient size to provide for the fastening means of the novelty button to extend past the device when said novelty button is inserted into the device providing for unfettered access to the fastening means by the user.

* * * * *